United States Patent [19]

Broido

[11] Patent Number: 5,022,191

[45] Date of Patent: Jun. 11, 1991

[54] POLISHING PLATE

[75] Inventor: Georges H. G. Broido, Collonges Sous Saleves, France

[73] Assignee: Lam-Plan S.A., France

[21] Appl. No.: 434,846

[22] Filed: Nov. 13, 1989

[30] Foreign Application Priority Data

Nov. 22, 1988 [FR] France ..... 88 13919

[51] Int. Cl.[5] ..... B24B 1/00

[52] U.S. Cl. ..... 51/209 DL; 51/317; 51/DIG. 6

[58] Field of Search ..... 51/209 DL, 317, DIG. 6, 51/DIG. 2, 209 R, 209 S, 129

[56] References Cited

U.S. PATENT DOCUMENTS

| | | | |
|---|---|---|---|
| Re 27,962 | 4/2/74 | Kubsh | 5/209 RX |
| 342,943 | 5/1886 | Badger | 51/209 DL |
| 1,622,942 | 3/1927 | Chase | 51/209 S |
| 1,926,321 | 9/1933 | Turek | 51/209 R X |
| 3,913,279 | 10/1975 | Broido | 51/295 X |
| 3,921,342 | 11/1975 | Day . | |
| 4,037,367 | 7/1977 | Kruse . | |
| 4,581,853 | 4/1986 | Marcus | 51/7 |

FOREIGN PATENT DOCUMENTS 1104941 11/1955 France .

OTHER PUBLICATIONS

Patent Abstract of japan, vol. 7, No. 197 (M-239) (1342), Aug. 27, 1983, JP-A 58 94 965 (Yoshiaki Hagiuda), Jun. 6, 1983.

*Primary Examiner*—Frederick R. Schmidt
*Assistant Examiner*—Bruce P. Watson
*Attorney, Agent, or Firm*—Eckert Seamans Cherin & Mellott

[57] ABSTRACT

A polishing plate wherein the arcs cut in the soft parts by a circle whose radius is equal to approximately half that of the disk and whose center is at a distance from that of the disk equal to half the radius of the disk have a length between 0.5 and 5 mm.

15 Claims, 5 Drawing Sheets

POLISHING PLATE

BACKGROUND OF THE INVENTION

1. Field of the Invention

The present invention relates to polishing or lapping plates, particularly those used in polishing machines comprising a plate driven to rotate about its axis, a work holder offset relative to the plate and driven, particularly by friction, to rotate about its own axis, and an abrasive suspension interposed between the workpieces being polished and the plate, the workpieces being applied against the plate, with the interposition of the suspension, with a certain pressure.

2. Prior Art

In U.S. Pat. No. 3,913,279 a polishing plate is described on whose plane surface appear flush soft parts in the form of islets regularly disseminated in a continuous hard part. In the present specification the expression "hard parts" is used to mean parts harder than the soft parts of the plate. The soft parts are distributed regularly in concentric circles on the plate. No importance is attached to the lengths of the gaps between the hard parts, which in the drawing, and in the corresponding plate on sale commercially, are very large.

In Swiss Patent No. 641,396 a polishing plate is described in which the soft parts are in the form of a continuous spiral. The width of the spiral is not specified. It is of the order of 10 mm in the corresponding product on sale commercially and also has that length in the drawing if it is assumed that the plate illustrated has the diameter usual in the art.

SUMMARY OF THE INVENTION

It has now unexpectedly been found that the lengths of the gaps between hard parts play a decisive part in respect of the polishing yield or amount of material removed per unit of time.

The invention therefore relates to a polishing plate giving an increased yield.

The plate according to the invention is characterized in that more than half of the arcs cut in the soft parts by an imaginary circle, whose radius is equal to 9/20ths of that of the disk and whose center is at a distance from that of the disk equal to half the radius of the disk, have a length between 0.5 and 8 mm.

Strictly speaking the curve in question on which the arcs are cut is the trace of the trajectory on the plate of a point on the workpiece which is to be polished or lapped. Such curves are shown in the drawings. However, for the sake of simplification they may be likened to the imaginary circle with sufficient approximation for the purpose of defining the invention.

80%, or better still 90%, of the arcs preferably have a length between 0.5 and 5 mm and, even better, between 1 and 4 mm.

There is an arc length, which is very short compared with the prior art, which gives optimum yield.

If, for the purpose of facilitating manufacture, it is desired to give identical shapes to the hard parts, the criterion laid down by the invention can be met only if the hard parts forms isolated islets in a soft matrix which is continuous, that is to say in a single piece. This form of construction is contrary to the form known in the prior art. It is also found that it enables the plate to be given greater flatness.

The islets are preferably rectangular, the ratio of the length of the longer sides to that of the shorter sides being between 1.5 and 3. The results are improved by depressions formed in the longer sides.

The prior art considered that the optimum yield was achieved with hard parts amounting to 70% and soft parts to 30%. However, when the arc length criterion is met, tests show that the best yield is obtained when the hard parts represent from 85 to 95% of the sum of the hard parts and soft parts.

The hard parts of the plate may be powders of cast iron, iron, copper, stainless steel, chromium, carbide, oxides, particularly aluminium oxide, preferably mixed with resins such as polyester resins, acrylic resins and phenolformaldehyde resins. The soft parts may be metallic powders, for example of copper, bronze, copper and lead alloys, brass, copper and aluminium alloys, aluminium, lead, antimony, tin, and zinc, preferably also mixed with resins, particularly polyester, acrylic and phenolformaldehyde resins. In these mixtures of resins and metallic powders, the resin advantageously represents from 20 to 40% of the total weight.

The abrasives used are products having on the Mohs scale a hardness of at least 9 and on the Knoop scale a hardness greater than 1,200. These abrasives, which are harder than the hard parts of the plate, are in particular corundum, fused alumina, silicon carbide, boron carbide and diamond, the latter being preferred. The abrasive is in the form of a suspension of the abrasive products mentioned above, in a binder, the particle size of the abrasives being between 1 micron and 200 microns, preferably between 10 microns and 40 microns, and the percentage of abrasives in the binder being between 0.2 and 5% by weight and preferably between 1 and 3% by weight. The binder may consist of a mixture of water and glycols, the glycols representing from 10 to 60% of the total weight of the binder and preferably from 20 to 50% of that weight. The binder may also consist of a mixture of water and kerosene, the latter representing from 40 to 60% of the total weight of the binder.

BRIEF DESCRIPTION OF THE DRAWINGS

In the accompanying drawing, given solely by way of example.

DETAILED DESCRIPTION OF THE PREFERRED EMBODIMENTS

Figure 1:
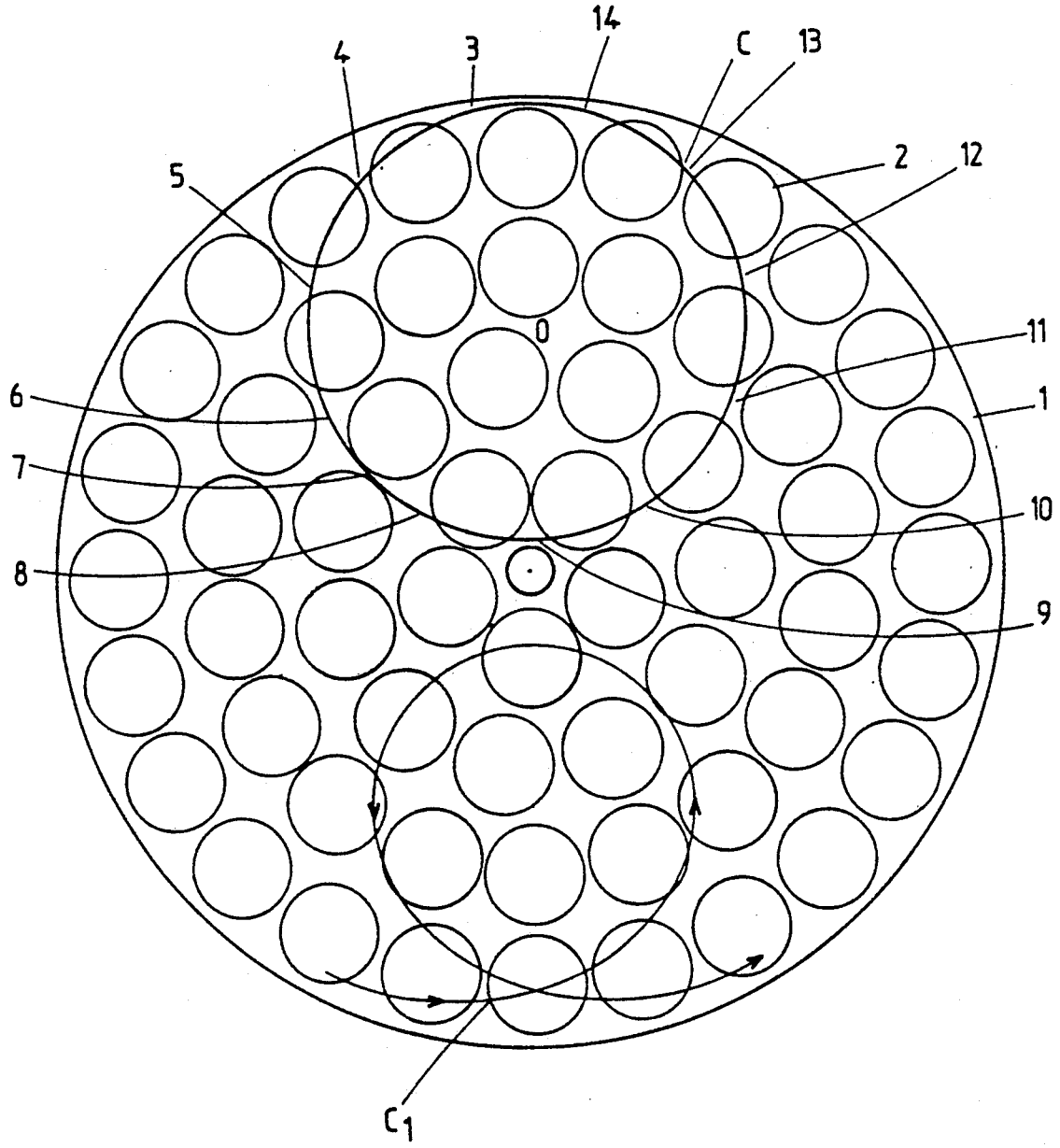
FIGS. 1 to 4 are plan views of plates according to the invention, which have a diameter of 230 mm.

The lapping plate shown in FIG. 1 consists of a matrix 1 of a mixture of resin and copper, the resin representing ⅔ by weight of the mixture. The matrix 1 is continuous and constitutes the soft parts. The hard parts consist of islets 2, whose faces flush with the surface of the plate are circular, having a diameter of 25 mm.

The curve C1 is also shown, which is the trace on the polishing plate of a point of an object to be polished. On the soft matrix this curve C1 cuts arcs of which more than 50% have a length between 1 and 5 mm. This curve may also be likened to the imaginary circle C whose radius is equal to half that of the disk, and whose center is at a distance from that of the disk equal to half the radius of the disk. On the soft matrix this circle cuts the arcs 3 to 13, whose respective lengths are 8, 3, 6, 12, 2, 17, 10, 7, 8, 6, 2 and 12.

Figure 2:
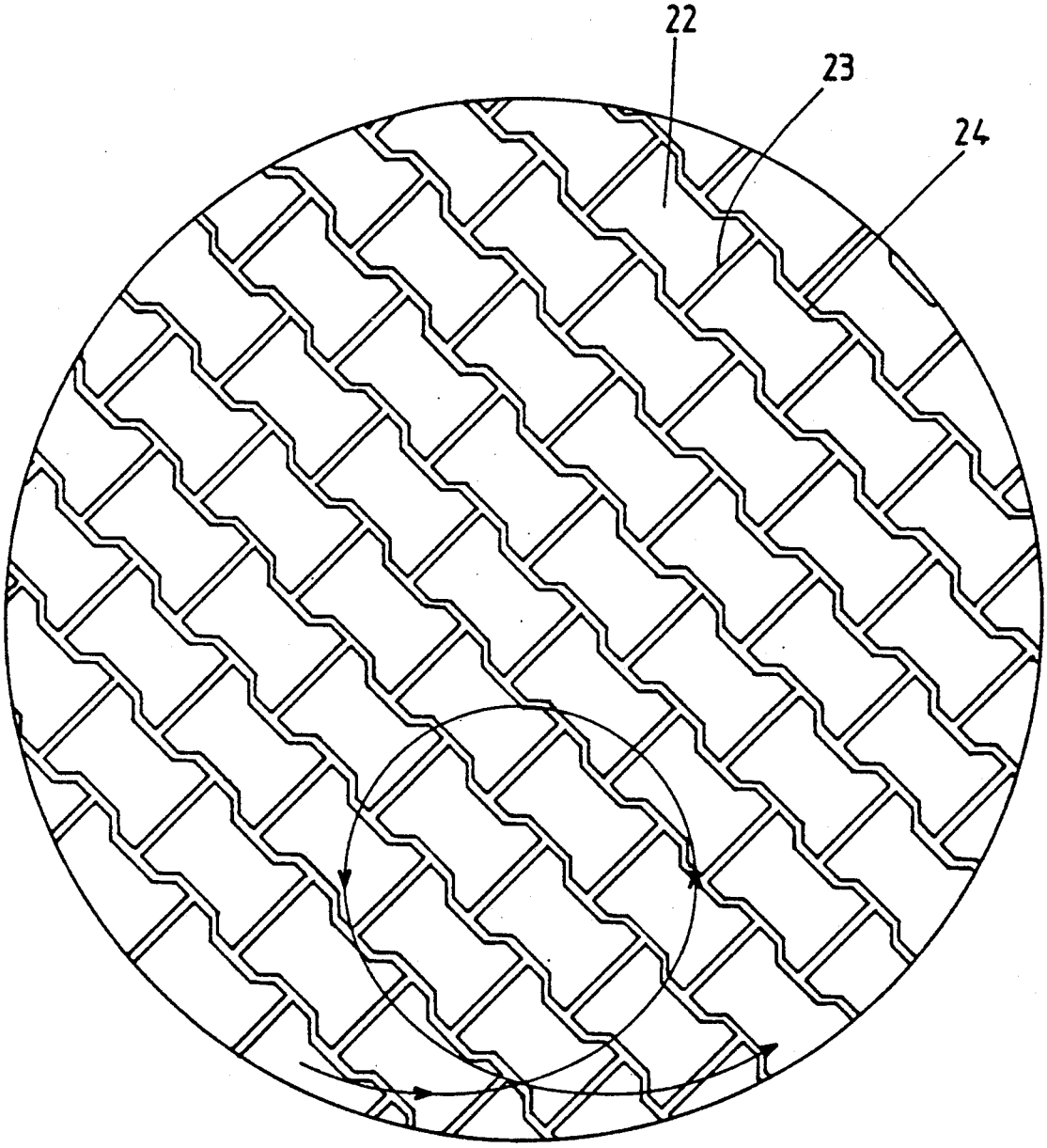

In FIG. 2 the islets 22 have substantially the shape of a rectangle whose longer sides are provided with depressions. The space between two shorter sides 23 of a rectangle is 2 mm. The space between the two depressed parts 24 of the longer sides of the rectangle is likewise 2 mm. The space between the longer side segments immediately adjacent to the shorter sides 23 is 2 mm. The space between the portions connecting the depressed parts to the remainder of the longer sides is only 1 mm.

Figure 3:
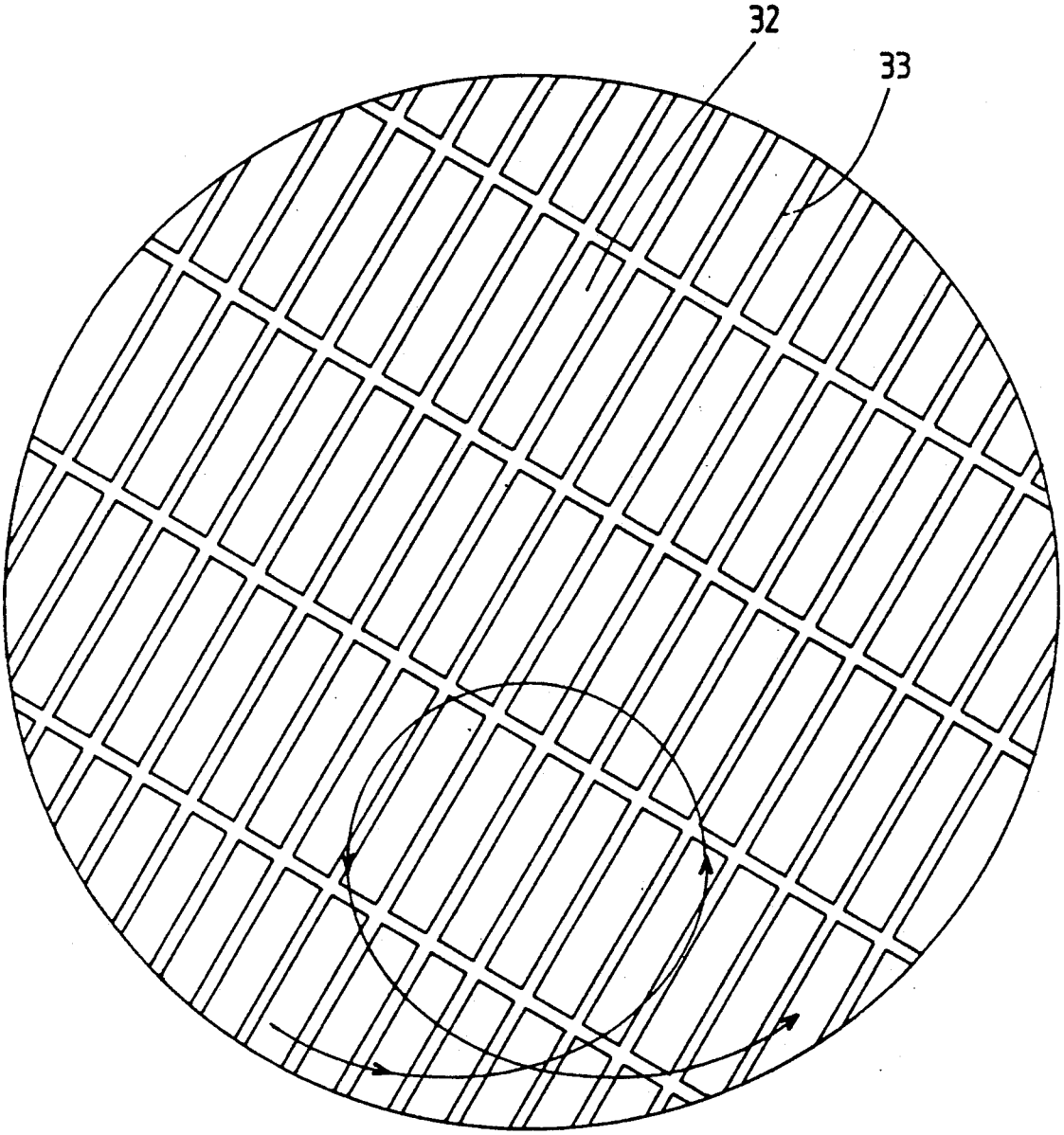

In FIG. 3 the hard rectangular islets 32 are disseminated in a matrix 33. The distance separating two islets, measured along their sides, is 2 mm.

Figure 4:
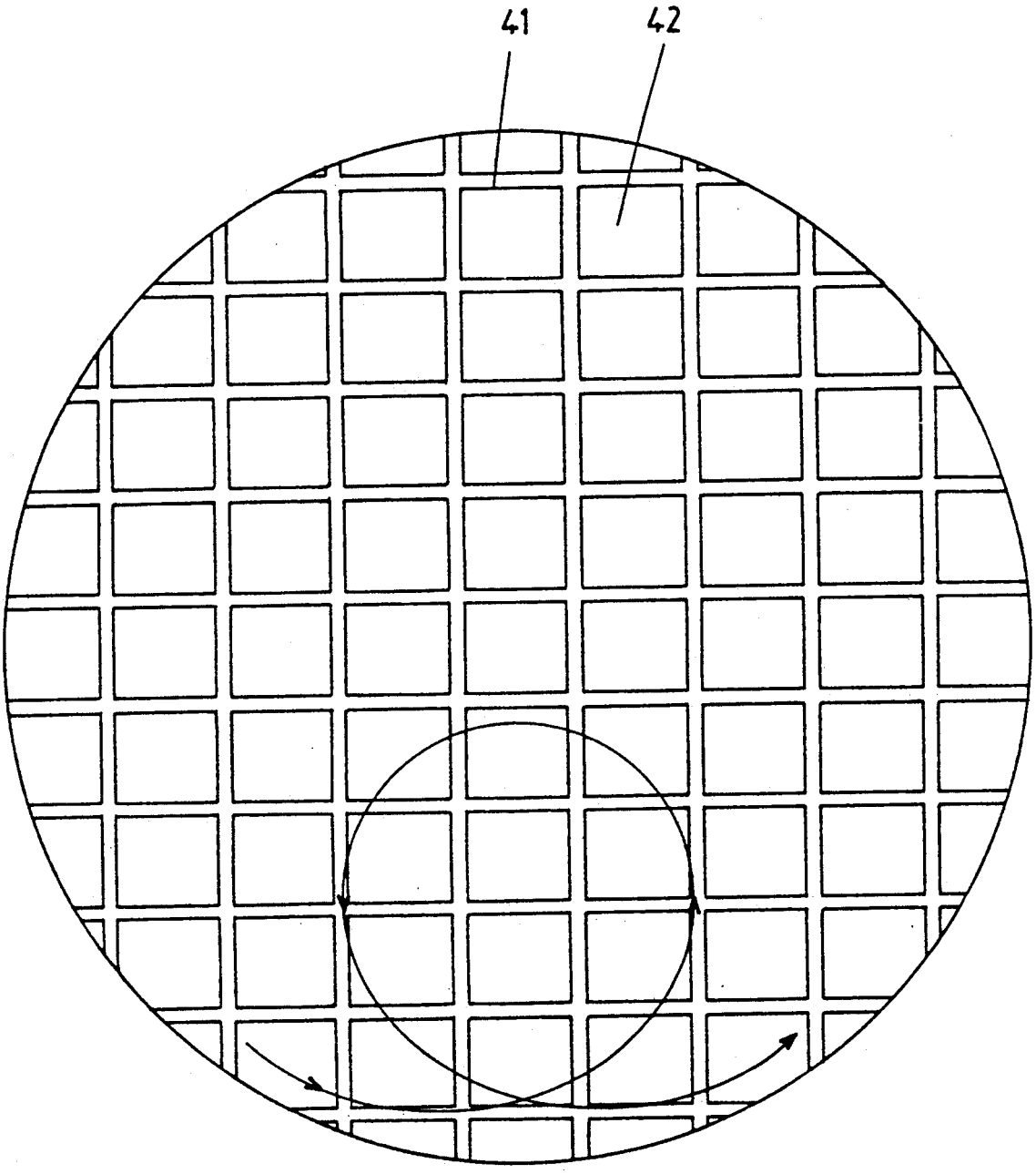

In FIG. 4 the hard islets 42 are disseminated in the soft matrix 41, the distance separating two islets being such that the arcs cut in the soft parts have lengths between 0.5 and 5 mm.

In order to determine the yield of the plates, six cylindrical workpieces of a diameter of 20 mm are lapped by applying a pressure of 265 g/cm$^2$ in a lapping machine, the speed of rotation of the machine being 150 revolutions per minute and the speed of rotation of the workpiece holder being 175 revolutions per minute, which corresponds to a linear speed of the workpieces of 0.8 m/s. Six cycles lasting 5 minutes each are carried out. The abrasive used is brand MM 381 diamond liquid supplied by the applicants. The removal of material is measured in microns every five minutes on the six workpieces. The total removal of material is also measured on all the workpieces in all the cycles.

For a prior art plate of the Applicants, as described in the United States of America patent previously mentioned, the removal of material amounts to 615. This material removal value is taken as a base index equal to 100.

The results obtained are shown in Table I. In Table II the soft islets of the prior art plate have been replaced with hard islets in such a manner that these hard islets represents 71% of the plate surface, whereas the soft islets represented 70% of the prior art plate. The results obtained are shown in Table II.

TABLE I

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 19 | 20 | 20 | 20 | 24 | |
| 2 | 16 | 20 | 20 | 16 | 22 | |
| 3 | 16 | 21 | 17 | 19 | 21 | |
| 4 | 19 | 22 | 19 | 21 | 22 | |
| 5 | 20 | 20 | 25 | 21 | 23 | |
| 6 | 22 | 20 | 22 | 24 | 24 | |
| TOTAL REMOVAL OF MATERIAL | 112 | 123 | 123 | 121 | 136 | TOTAL REMOVAL OF MATERIAL/5 CYCLES |
| MEAN REMOVAL OF MATERIAL | 3,73 | 4,1 | 4,1 | 4,03 | 4,53 | 615 |
| DIVER-GENCE | 6 | 6 | 8 | 8 | 3 | |

TABLE II

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 31 | 26 | 31 | 31 | 29 | |
| 2 | 27 | 27 | 28 | 24 | 26 | |
| 3 | 27 | 27 | 28 | 26 | 23 | |
| 4 | 33 | 30 | 26 | 28 | 29 | |
| 5 | 36 | 27 | 32 | 33 | 35 | |
| 6 | 34 | 28 | 36 | 26 | 38 | TOTAL REMOVAL OF MATERIAL/5 CYCLES |
| TOTAL REMOVAL OF MATERIAL | 193 | 167 | 178 | 168 | 180 | 886 |
| MEAN REMOVAL OF MATERIAL | 6,43 | 5,56 | 5,93 | 5,6 | 6 | |
| DIVER-GENCE | 9 | 4 | 11 | 7 | 15 | |

The yield is 144.

Table III gives the results for a plate of the same type as that in FIG. 1, but having islets of a diameter of 20 mm. The percentage of islets is 70%. The yield is 141. Table IV gives the results for a plate of the same type as that in FIG. 1, but with islets of a diameter of 13 mm. The percentage of islets is 72. The yield is 135.

Figure 5:
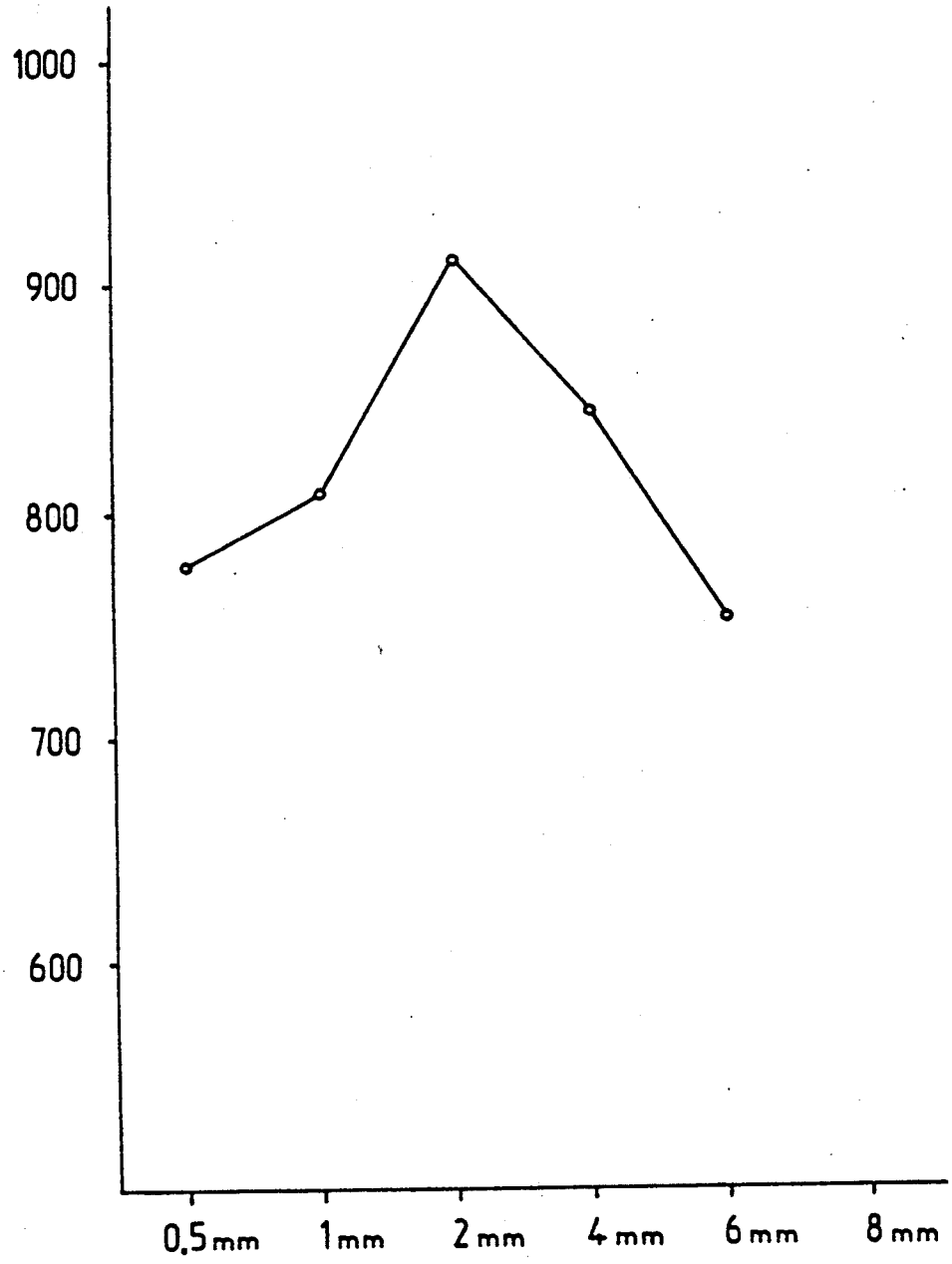
FIG. 5 is a graph illustrating the invention.

Tables V to X give the results obtained with plates according to FIG. 2, but with spaces between the two shorter sides of the hard islets and the depressed parts of the longer sides of the hard islets equal respectively to 0.5, 1, 2, 4, 6 and 8 mm. The percentages of hard islets are 95, 91, 81, 69, 57 and 51 respectively. The yields are 126, 131, 148, 137, 122, 103. FIG. 5 plots the variation of removal of material with respect to the spaces between the hard parts. It can clearly be seen that maximum removal of material is obtained with a value close to 2 mm, the range extending from 0.5 to 6 mm corresponding to removals of material greater than 750. There is a close correlation between the length of the arcs cut in the soft parts and the lengths of the spaces between the hard parts.

In all these tables it has in addition been found that the smaller the difference in measurements (divergence) between the workpieces for the different passes, the better the yield.

Table XI gives the results obtained with a plate according to FIG. 3, and Table XII the results with a plate according to FIG. 4. The yields are 147 and 140.

TABLE III

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 27 | 23 | 34 | 32 | 29 | |
| 2 | 24 | 27 | 29 | 30 | 24 | |
| 3 | 22 | 29 | 30 | 24 | 22 | |
| 4 | 28 | 27 | 28 | 26 | 25 | |
| 5 | 30 | 33 | 32 | 32 | 31 | |
| 6 | 32 | 35 | 32 | 36 | 32 | TOTAL REMOVAL OF MATERIAL/5 CYCLES |
| TOTAL REMOVAL OF MATERIAL | 163 | 174 | 185 | 180 | 163 | 865 |
| MEAN REMOVAL OF MATERIAL | 5,43 | 5,8 | 6,16 | 6 | 5,43 | |
| DIVER-GENCE | 10 | 8 | 6 | 8 | 10 | |

TABLE IV

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 22 | 26 | 30 | 28 | 31 | |
| 2 | 20 | 22 | 28 | 28 | 29 | |
| 3 | 21 | 23 | 25 | 27 | 30 | |
| 4 | 23 | 23 | 35 | 26 | 32 | |
| 5 | 31 | 24 | 34 | 35 | 29 | |
| 6 | 24 | 28 | 34 | 36 | 29 | TOTAL REMOVAL OF MATERIAL/5 CYCLES |
| TOTAL REMOVAL OF MATERIAL | 141 | 146 | 186 | 180 | 180 | 833 |
| MEAN REMOVAL OF MATERIAL | 4,7 | 4,86 | 8,2 | 6 | 6 | |
| DIVER-GENCE | 11 | 6 | 10 | 10 | 3 | |

TABLE V

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 22 | 25 | 27 | 29 | 23 | |
| 2 | 23 | 27 | 23 | 33 | 24 | |
| 3 | 19 | 27 | 30 | 29 | 24 | |
| 4 | 21 | 24 | 31 | 31 | 24 | |
| 5 | 19 | 26 | 29 | 29 | 23 | |
| 6 | 22 | 25 | 27 | 28 | 23 | TOTAL REMOVAL OF MATERIAL/5 CYCLES |
| TOTAL REMOVAL OF MATERIAL | 126 | 154 | 177 | 179 | 139 | 775 |
| MEAN REMOVAL OF MATERIAL | 4,2 | 5,13 | 5,9 | 5,96 | 4,6 | |
| DIVER-GENCE | 4 | 3 | 8 | 5 | 1 | |

TABLE VI

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 24 | 27 | 27 | 27 | 27 | |
| 2 | 25 | 26 | 28 | 31 | 25 | |
| 3 | 24 | 28 | 29 | 30 | 27 | |
| 4 | 29 | 26 | 28 | 30 | 27 | |
| 5 | 24 | 26 | 29 | 27 | 26 | |
| 6 | 24 | 24 | 28 | 28 | 28 | TOTAL REMOVAL OF MATERIAL/5 CYCLES |
| TOTAL | 150 | 157 | 169 | 173 | 157 | 806 |

TABLE VI-continued

| No | REMOVAL OF MATERIAL | REMOVAL OF MATERIAL | REMOVAL OF MATERIAL | REMOVAL OF MATERIAL | REMOVAL OF MATERIAL |
|---|---|---|---|---|---|
| REMOVAL OF MATERIAL MEAN | 5 | 5,23 | 5,63 | 5,76 | 5,2 |
| REMOVAL OF MATERIAL DIVER-GENCE | 5 | 5 | 2 | 4 | 3 |

TABLE VII

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 28 | 28 | 32 | 31 | 30 | |
| 2 | 30 | 30 | 32 | 32 | 31 | |
| 3 | 31 | 31 | 32 | 33 | 31 | |
| 4 | 29 | 30 | 32 | 32 | 28 | |
| 5 | 28 | 29 | 32 | 31 | 29 | |
| 6 | 29 | 28 | 31 | 30 | 29 | TOTAL REMOVAL OF MATERIAL/5 CYCLES |
| TOTAL REMOVAL OF MATERIAL | 175 | 176 | 191 | 189 | 178 | 909 |
| DIVER-GENCE | 3 | 3 | 1 | 3 | 3 | |

TABLE VIII

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 26 | 29 | 27 | 22 | 26 | |
| 2 | 26 | 30 | 27 | 30 | 30 | |
| 3 | 28 | 29 | 29 | 30 | 28 | |
| 4 | 29 | 27 | 30 | 30 | 29 | |
| 5 | 27 | 28 | 29 | 27 | 28 | |
| 6 | 25 | 28 | 26 | 29 | 27 | TOTAL REMOVAL OF MATERIAL/5 CYCLES |
| TOTAL REMOVAL OF MATERIAL | 161 | 171 | 168 | 175 | 168 | 843 |
| MEAN REMOVAL OF MATERIAL | 5,36 | 5,7 | 5,6 | 5,83 | 5,6 | |
| DIVER-GENCE | 4 | 4 | 4 | 8 | 4 | |

TABLE IX

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 23 | 26 | 24 | 24 | 24 | |
| 2 | 23 | 27 | 25 | 25 | 25 | |
| 3 | 25 | 27 | 26 | 26 | 27 | |
| 4 | 26 | 26 | 25 | 24 | 29 | |
| 5 | 24 | 26 | 24 | 25 | 24 | |
| 6 | 23 | 26 | 24 | 25 | 24 | TOTAL REMOVAL OF MATERIAL/5 CYCLES |
| TOTAL REMOVAL OF MATERIAL | 144 | 158 | 148 | 149 | 153 | 752 |
| DIVER-GENCE | 3 | 3 | 2 | 2 | 5 | |

TABLE X

| No | REMOVAL OF MATERIAL | REMOVAL OF MATERIAL | REMOVAL OF MATERIAL | REMOVAL OF MATERIAL | REMOVAL OF MATERIAL |
|---|---|---|---|---|---|
| 1 | 20 | 21 | 22 | 21 | 21 |
| 2 | 22 | 22 | 21 | 20 | 22 |
| 3 | 22 | 21 | 22 | 21 | 23 |

TABLE X-continued

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 4 | 19 | 22 | 21 | 20 | 23 | |
| 5 | 21 | 12 | 20 | 21 | 20 | |
| 6 | 19 | 22 | 19 | 21 | 22 | TOTAL REMOVAL OF MATERIAL/5 CYCLES |
| TOTAL REMOVAL OF MATERIAL | 123 | 129 | 125 | 124 | 131 | 632 |
| DIVER-GENCE | 3 | 1 | 3 | 1 | 3 | |

TABLE XI

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 26 | 32 | 30 | 31 | 31 | |
| 2 | 31 | 29 | 30 | 32 | 31 | |
| 3 | 30 | 29 | 31 | 33 | 31 | |
| 4 | 32 | 27 | 33 | 33 | 29 | |
| 5 | 29 | 28 | 31 | 31 | 28 | |
| 6 | 27 | 31 | 28 | 30 | 29 | TOTAL REMOVAL OF MATERIAL/5 CYCLES |
| TOTAL REMOVAL OF MATERIAL | 175 | 176 | 183 | 190 | 179 | 903 |
| DIVER-GENCE | 6 | 5 | 5 | 3 | 3 | |

TABLE XII

| No | REMOVAL OF MATERIAL | REMOVAL OF MATERIAL | REMOVAL OF MATERIAL | REMOVAL OF MATERIAL | REMOVAL OF MATERIAL | |
|---|---|---|---|---|---|---|
| 1 | 27 | 28 | 28 | 30 | 30 | |
| 2 | 28 | 30 | 27 | 33 | 29 | |
| 3 | 28 | 29 | 30 | 33 | 30 | |
| 4 | 28 | 29 | 26 | 33 | 29 | |
| 5 | 29 | 26 | 30 | 30 | 29 | |
| 6 | 28 | 26 | 28 | 30 | 29 | TOTAL REMOVAL OF MATERIAL/5 CYCLES |
| TOTAL REMOVAL OF MATERIAL | 168 | 168 | 169 | 189 | 167 | 861 |
| DIVER-GENCE | 2 | 4 | 4 | 3 | 1 | |

I claim:

1. A circular polishing plate for use in conjunction with an abrasive suspension and having a center a radius and a plane surface on which appear flush soft and hard parts, wherein more than half of arcs cut in the soft parts by any one of a plurality of imaginary circles, whose radii are equal to 9/20ths of the radius of the plate and whose centers are at a distance from that of the plate equal to half the radius of the plate, have a length between 0.5 and 8 mm and wherein the hard parts are not abrasive.

2. The plate of claim 1, wherein at least 80% of the arcs have a length between 0.5 and 5 mm.

3. The plate of claim 2, wherein at least 90% of the arcs have a length between 0.5 and 5 mm.

4. The plate of claim 1, wherein the length of the arcs is between 1 and 4 mm.

5. The plate of claim 2, wherein the length of the arcs is between 1 and 4 mm.

6. The plate of claim 3, wherein the length of arcs is between 1 and 4 mm.

7. The plate of claim 1, wherein the hard parts form isolated islets in a soft matrix, which is continuous.

8. The plate of claim 7, wherein the islets are rectangular, with longer sides and shorter sides, the ratio of the length of the longer sides to that of the shorter sides being between 1.5 and 3.

9. The plate of claim 8, wherein depressions are formed in the longer sides.

10. The plate of claim 1, wherein the hard parts represent from 85 to 95% of the sum of the hard parts and soft parts.

11. The plate of claim 2, wherein the hard parts represent from 85 to 95% of the sum of the hard parts and soft parts.

12. The plate of claim 3, wherein the hard parts represent from 85 to 95% of the sum of the hard parts and soft parts.

13. The circular polishing plate according to claim 1, wherein the non-abrasive hard parts have a hardness lower than 9 on a Mohs scale.

14. A circular polishing plate used in conjunction with an abrasive suspension, said polishing plate having a center, a radius and a plane surface on which appear flush soft and hard parts, said soft and hard parts being non-abrasive with respect to said abrasive suspension, wherein more than half of arcs cut in the soft parts by any one of a plurality of imaginary circles, whose radii are equal to 9/20ths of the radius of the plate and whose centers are at a distance from that of the plate equal to half the radius of the plate, have a length between 0.5 and 8 mm.

15. A circular polishing plate according to claim 14, in which the soft and hard parts have a hardness lower than 9 on a Mohs scale.

* * * * *